United States Patent [19]

Wheeler et al.

[11] 4,355,200

[45] Oct. 19, 1982

[54] POLYMER ROD INSULATOR WITH IMPROVED RADIO NOISE AND CORONA CHARACTERISTICS

[75] Inventors: Edward S. Wheeler, Batavia; Anthony J. Campagna, Amherst, both of N.Y.

[73] Assignee: Interpace Corporation, Parsippany, N.J.

[21] Appl. No.: 201,136

[22] Filed: Oct. 27, 1980

[51] Int. Cl.[3] ..... H01B 17/42; H01B 17/12

[52] U.S. Cl. ..... 174/140 S; 174/179

[58] Field of Search ..... 174/140 R, 140 S, 141 R, 174/179, 186, 209, 211

[56] References Cited

U.S. PATENT DOCUMENTS 3,878,321 4/1975 Ely ..... 174/179 X 4,217,466 8/1980 Kuhl ..... 174/209

FOREIGN PATENT DOCUMENTS 1510264 5/1978 United Kingdom ..... 174/179

*Primary Examiner*—Laramie E. Askin

*Attorney, Agent, or Firm*—Charles E. Baxley

[57] ABSTRACT

This disclosure teaches a suspension insulator comprised typically of a fiberglass rod with mounted metal hardware at each end and juxtaposed polymer sheds strung thereon, which insulator has been improved for high voltage application. Above system voltages of about 138 kV, undesirable radio noise and corona occurs in the area of the metal hardware in conventional designs. Addition of semiconducting polymers between the metal hardward and the polymer sheds significantly reduces the level of generated radio noise and eliminates the corona.

3 Claims, 4 Drawing Figures

POLYMER ROD INSULATOR WITH IMPROVED RADIO NOISE AND CORONA CHARACTERISTICS

BACKGROUND OF THE INVENTION

Polymer rod suspension insulators, like all rod type insulators, suffer from nonlinear voltage distribution along their lengths to an even greater extent than insulators which are broken up with intervening metal portions, such as conventional ceramic suspension insulators. This nonlinear distribution puts excessive voltage stresses in the areas near the metal fittings of the insulator, particularly at the energized end. As the voltage class of the insulator increases, the stresses become greater. Eventually, there may be a breakdown of the air in the high stress area, creating corona and radio noise.

With polymer insulators, the phenomenon occurs with units energized on system voltages above 138 kV. Up through 138 kV system voltage, the standard end fitting is sufficient to maintain radio influence voltage (radio noise) values below 100 $\mu$V at the nominal operating line to ground voltage or even 10% or more above nominal.

However, at system voltages of 161 kV and above, excessive radio noise is generated and the standard design cannot be used. There is needed some simple and effective way to reduce the voltage stress to levels where it will not cause visible corona and excessive radio noise.

This reduction of voltage stress may be accomplished by the well known means of corona rings. However, such rings are expensive, awkward in size and visually obtrusive at such voltages as 161 kV where overhead lines are relatively close to the ground level observer.

SUMMARY OF THE INVENTION

The creation of the condition leading to breakdown of the air lies in the high field flux density (voltage gradient) at the interface of the end fitting and the insulation. At this interface the organic insulation, the metal end fitting and the surrounding air all are present in a high field flux. Voltage levels and accompanying field fluxes can be tolerated up to a certain value before the air breaks down. Even with high system voltage, if the steep voltage gradient can be reduced, the problem of corona and radio noise can be avoided.

By use of semiconductive polymers at the high voltage metal end fitting the voltage gradient is reduced and radio noise and corona are eliminated or reduced to acceptable low levels. We have also found that this objective, as well as an increase in leakage distance which itself is desirable for any insulator and particularly those for use in contamination conditions, can be achieved by use of a special shed. Furthermore this special shed, which can be called a "corona shed", can be essentially similar in appearance to all the other sheds on the insulator, giving it a pleasing appearance. Such a corona shed additionally is not of great cost as it can be fabricated readily by conventional molding techniques.

With the use of semiconductive polymers, we have found also that it is not necessary to insure that the corona shed is electrically intimately contacting the end fitting throughout. It is only necessary that contact at some point(s) be made, as this will eliminate any voltage discrepancies across any void spaces. With any design not using semiconducting rubber adjacent to the end fittings, if any air voids remain between the insulating material and the end fitting, there could be present an air to organic insulation to metal interface with a tendency to create corona and radio noise. If such a corona is created, it may cause damage to the organic insulation and eventually destroy same. Inasmuch as the corona shed generally is formed separately from the metal end fitting, and because the end fitting may not be uniformly smooth, there is a high likelihood that such deleterious voids may exist at the interface of the end fitting and the shed which in a sense encapsulates the end fitting.

Some past attempts to provide such encapsulating sheds for insulator end fittings have relied upon greases to fill any voids at the interface. Such greases, however, are subject to migration and/or absorption into the solid organic insulation material over a period of time and consequently may not provide a permanent answer. Two constructions with unbonded components are shown in U.S. Pat. Nos. 3,549,791 and 3,898,372. Prior designs of the bonded or vulcanized type are shown in British Pat. Nos. 1,182,045 and 1,292,276; German printed applications Nos. 2,650,363 and 2,746,870 corresponding to U.S. Pat. Nos. 4,217,466 and 4,246,696, respectively.

BRIEF DESCRIPTION OF THE DRAWINGS

The invention will be understood more fully from the accompanying drawings wherein.

DESCRIPTION OF PREFERRED EMBODIMENTS

Figure 1:
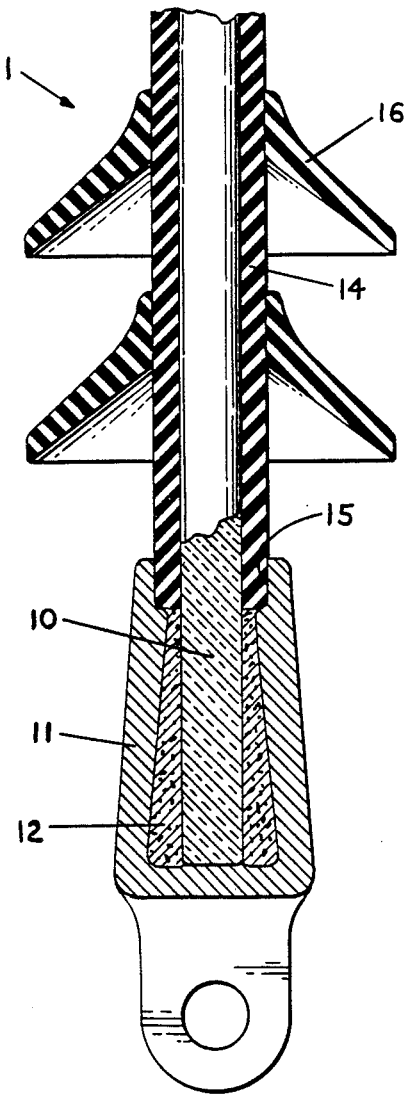
FIG. 1 (PRIOR ART)
FIG. 1 is an elevational view in section of a polymer suspension insulator according to a prior art design.

As shown in FIG. 1, a suspension insulator generally designated 1 of design according to the prior art comprises a central member 10 composed of resin bonded glass fibers to which metallic fittings 11 have been secured to the lower and upper ends. These metallic fittings 11 may be secured to the central member 10 any number of ways, but a cast epoxy cone 12 has been shown and is typical. The central member 10 is encased in a sheath 14 which may be sealed to a lip 15 of the end fitting 11. The sheath 14 has bonded to it a series of weathersheds 16 which are generally identical. The construction for a suspension insulator is well known in the art but because of high field fluxes near the end fitting at higher voltages, in service radio noise will be present at those higher voltages, particularly above 138 kV system voltage.

Figure 2:
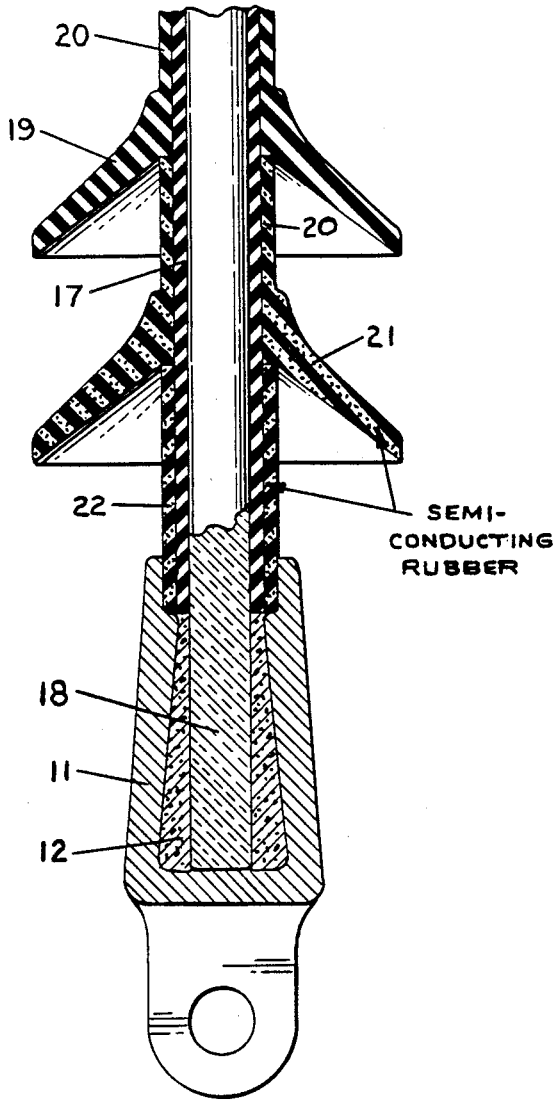
FIG. 2 is an elevational view in section of one embodiment of a polymer suspension insulator according to the present invention.

As shown in FIG. 2, we have found that a suitable polymer insulator design embodying the principle of a semiconducting "skin" over an insulating body can be achieved. One embodiment of the design according to the present invention consists of an insulating sheath 17 over the length of a fiberglass rod 18, over which sheds 19 with collars 20 are placed. The design of the sheds 19 with integral collars 20 in such that each shed with its collar contacts the next shed 19 (with collar 20). As clearly shown in FIG. 2, each collar 20 engages in a groove formed by the next adjacent shed. The shed (with collar 20) which is closest to a metallic end fitting 11, must extend to the end fitting. In FIG. 2, this contact is accomplished by means of a sleeve 22. By this expedient a continuous shed 19 (with collar 20) surface entirely covers the sheath 17. Both the sheath 17 and sheds 19 (with collars 20) can be of materials found suitable for outdoor use as high voltage insulators, for example ethylenepropylene rubber. The sheds 19 (with collars 20) must be bonded adequately to the sheath 17 and the sheath 17 to the rod 18 in order to avoid any interfacial path for current flow, moisture accumulation, etc. This bonding may be accomplished by means of adhesives or by vulcanization of an unvulcanized sheath 17 to previously vulcanized sheds 19 (with collars 20) and to the rod 18.

If the sheds 19 (with collars 20) are all of an insulating formulation, no effect of stress dissipation will be found. However, when a shed 21 (with collar 20) and a contact sleeve 22 nearest the end fitting are semiconducting, the high electrical stress spreads out over a greater area, with significant reduction in corona intensity. The invention also has been found to be effective when a plurality of sheds 21 (with collars 20) and a contact sleeve 22 all are made semiconductive.

Figure 3:
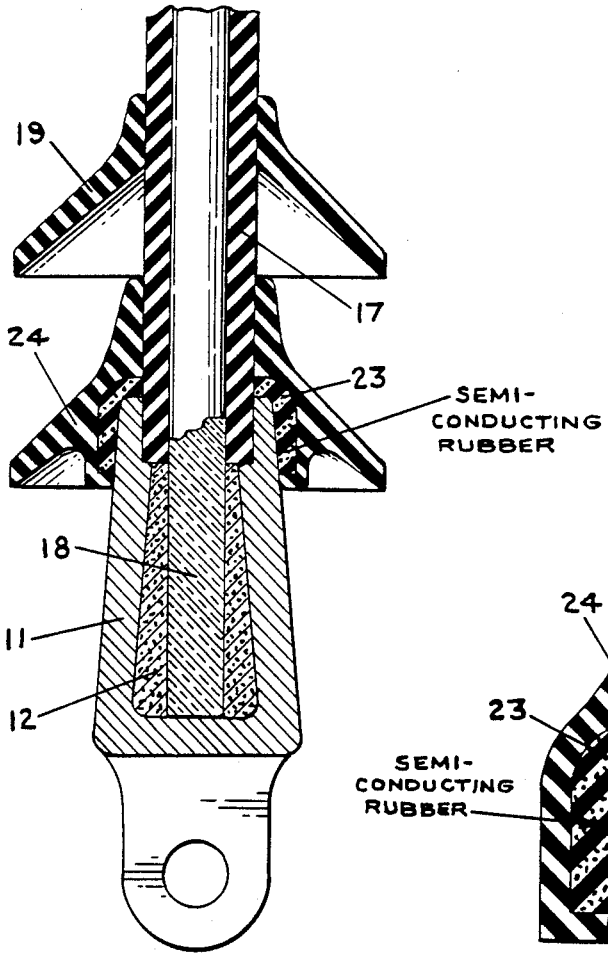
FIG. 3 is an elevational view in section of a second embodiment of a polymer suspension insulator according to the present invention.

Another embodiment of the invention, shown in FIG. 3, eliminates the need for entirely voidfree construction between the elastomers of the insulator and the end fitting. By surrounding a void with equipotential surfaces, no partial discharges will occur within that void. With the contacting elastomer 23 of shed 24 made conducting, it and the end fitting are both at the same electric potential with consequent reduction of radio noise when energized.

Insulators using the corona shed 21 and sleeve 22 design of FIG. 2 and the corona shed 23, 24 design of FIG. 3 have been tested and it has been found that these polymer suspension insulators can be used through system voltages of at least 230 kV with very low levels ($<100\ \mu V$) of radio interference voltage (RIV) and without visible corona. The same insulators without the invention, at those same test voltages, not only generate far higher RIV but also go into visible corona. These corona sheds are of modest cost compared to a corona grading ring and are far less bulky and obtrusive. The corona sheds have the same general outward appearance as unmodified insulators and, therefore, the corona sheds give a pleasing appearance to the observer. Furthermore, the semiconductive corona shed of FIG. 3 adds to the leakage distance of the insulator, thereby improving its performance in contamination conditions.

The specific design of the corona shed 23, 24 of FIG. 3 merits further comment. It is desirable to prevent erosion damage to the semiconducting elastomer portion 23 due to high leakage currents. Toward this objective the semiconducting elastomer portion 23 is disposed within a recess in and thereby substantially enclosed by track/erosion resistant nonconducting elastomer 24 on all sides exposed to weather and to surface leakage currents. This design of the corona shed 23, 24 is highly resistant to erosion and provides the desired answer to the radio noise problem and the problem of corona incident to high field flux at the rubber to metal to air junction.

Figure 4:
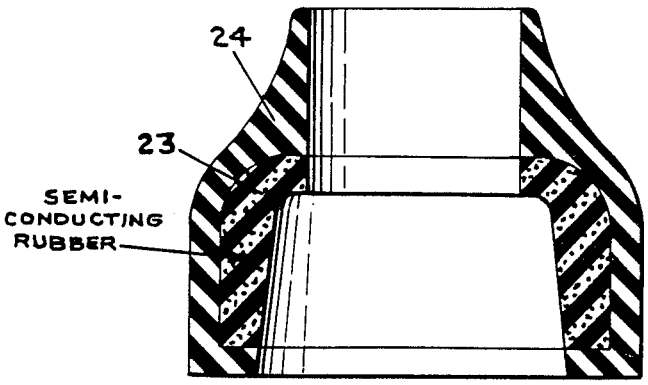
FIG. 4 is an elevational view in section of a semiconducting rubber piece without a protruding weathershed.

A piece closely related to the corona shed 23, 24 of FIG. 3 is shown in FIG. 4 and may be called a "corona shield". The corona shield differs from the corona shed only in that the corona shield has no protruding weathershed. The corona shield serves the same purpose of avoiding the radio noise problem and the corona activity. The corona shield is used in applications wherein a top end fitting needs such protection. As can be seen readily, were the corona shed to be used at the top end, it would be upside down and would collect rain water.

It will be understood by those skilled in the art to which this invention pertains that various deviations may be made from the embodiments of the corona shed and corona shield shown and described herein, without departing from a main theme of invention pertaining thereto as covered by the claims.

We claim:

1. An elongated high voltage insulator, for use with voltages in excess of 138 kV in an outdoor environment, and comprised operatively of:
   - an insulator member of nonconducting material,
   - a high voltage metal fitting secured to the insulator member,
   - a plurality of elastomeric segments on the insulator member with a proximal one of said segments contacting the high voltage metal fitting,
   - a portion of said proximal segment composed of semiconductive elastomeric material bearing directly against and providing an equipotential surface in contact with said high voltage metal fitting,
   - said proximal segment having nonconducting elastomeric material embracing said elastomeric semiconductive material to shield it from the environment.

2. An elongated high voltage insulator, for use with voltages in excess of 138 kV in an outdoor environment, and comprised operatively of:
   - a tension rod of nonconducting material,
   - a high voltage metal fitting secured to one end of the rod,
   - an elastomeric sheath substantially covering the rod,
   - a plurality of elastomeric segments on the sheath,
   - a proximal one of said segments contacting said high voltage metal fitting,
   - a portion of said proximal segment composed of a semiconductive elastomeric material bearing directly against and providing an equipotential surface in contact with said high voltage metal fitting,
   - said proximal segment having nonconducting elastomeric material embracing said elastomeric semiconductive material to shield it from the environment.

3. An elongated high voltage insulator, for use with voltages in excess of 138 kV in an outdoor environment, and comprised operatively of:
   - an insulator member of nonconducting material, a high voltage metal fitting secured to the insulator member,
   - an elastomeric sheath substantially covering the insulator member,
   - a plurality of elastomeric sheds on the sheath juxtaposed each to another and together substantially covering the sheath,
   - a collar formed integrally on each of the sheds with each of said collars engaged in a groove formed by a next adjacent of said sheds,
   - a terminal shed having a collar engaged in a groove formed by one of said sheds and being in contact with said high voltage metal fitting,
   - said terminal shed having a recess formed therein next to said high voltage metal fitting,
   - a semiconductive elastomeric material received in said recess and organized to bear directly against and to provide an equipotential surface in contact with said high voltage metal fitting.

* * * * *